United States Patent [19]

Morel

[11] 4,354,722

[45] Oct. 19, 1982

[54] TERMINAL CONNECTOR DEVICE FOR ELECTRICAL CONDUCTING WIRES

[75] Inventor: Henri Morel, Maule, France

[73] Assignee: ITW de France, Beauchamp, France

[21] Appl. No.: 156,142

[22] Filed: Jun. 3, 1980

[30] Foreign Application Priority Data

Jun. 5, 1979 [FR] France ..... 79 14290

[51] Int. Cl.[3] ..... H01R 4/29

[52] U.S. Cl. ..... 339/95 D; 339/260

[58] Field of Search ..... 339/95 D, 260

[56] References Cited

U.S. PATENT DOCUMENTS

| | | | |
|---|---|---|---|
| 2,780,791 | 2/1957 | Morschel | 339/95 D X |
| 3,152,851 | 10/1964 | McLaughlin | 339/95 D |
| 3,167,252 | 1/1965 | Smith | 339/95 D X |
| 3,596,229 | 7/1971 | Hohorst | 339/260 X |

FOREIGN PATENT DOCUMENTS

| | | | |
|---|---|---|---|
| 1434965 | 5/1976 | United Kingdom | 339/95 D |

*Primary Examiner*—Eugene F. Desmond

*Attorney, Agent, or Firm*—Jerold M. Forsberg; Jack R. Halvorsen

[57] ABSTRACT

This invention is a terminal connector device for electrical wires and comprises a flap member movable under the action of an actuating button, which flap is interposed, in a biased position, between a terminal entry member and a wire receiving support. The withdrawal of said flap from this interposing position, under the action of said button, permits the introduction of the wire whose connecting is obtained automatically by lateral wedging of the wire inserted into said receiving support by the action of said flap, when the button is released. The button is lockable to hold said flap in its retracted position permitting introduction of the wire, which position also enables the disconnection of a previously positioned wire.

11 Claims, 7 Drawing Figures

TERMINAL CONNECTOR DEVICE FOR ELECTRICAL CONDUCTING WIRES

The connection of electrical wires in terminals requires, more and more, a rapidity of positioning and of disengagement, associated with faultless reliability.

It is an object of the present invention to provide a terminal connector embeddable in the thickness of a support, e.g., a cabinet of an acoustic enclosure, which permits connection and disconnection of conducting wires for micro-voltages, rapidly and positively, without exagerrated extension beyond the front surface of the support.

The connector terminal of electrical wires, according to the invention is characterised in that it comprises a flap movable under the action of an actuating button. This flap is interposed, in a biased position, between an entrance of the terminal connector and a wire receiving support. The withdrawal of said flap from this interposition position, under the action of said button, permits the introduction of the wire whose connection is obtained automatically by lateral wedging of the wire by its being pushed into said receiving support by the action of said flap when the button is released from a locked position. There is a locking means provided to maintain said flap in its retracted position to permit the introduction of the wire, which position permits also the disconnection of a previously positioned wire.

Other features and advantages of the present invention will emerge from the description which follows given with reference to the accompanying drawings.

DESCRIPTION OF PREFERRED EMBODIMENTS

Figure 1:
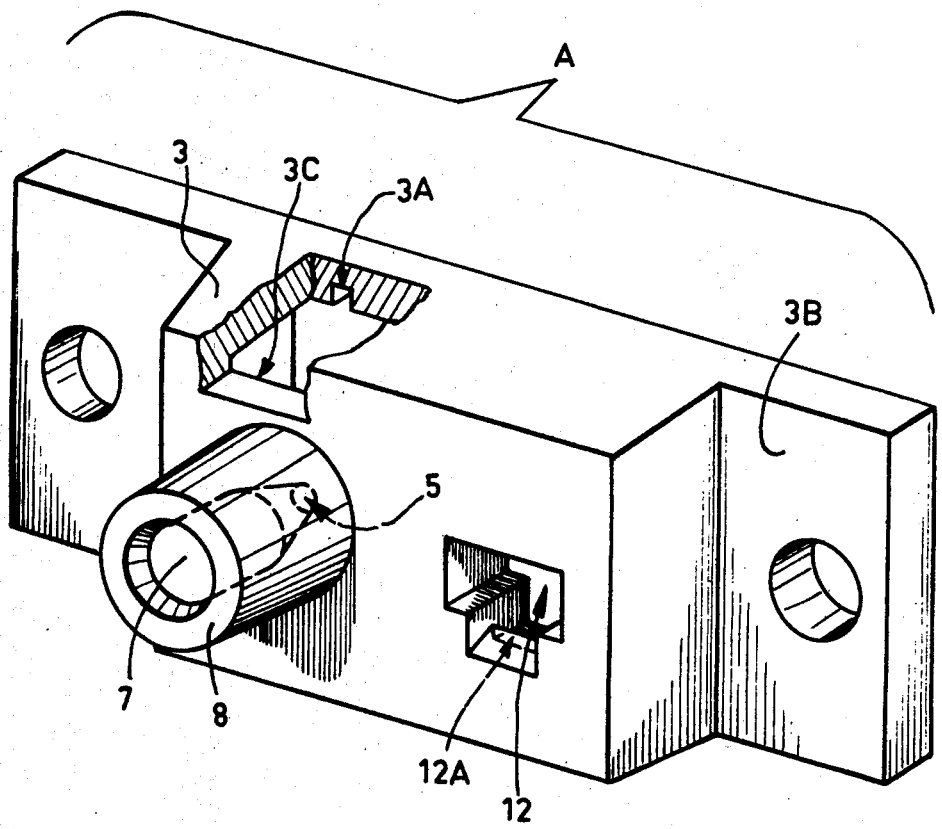
FIG. 1 is a perspective view, with part shown in section, of the casing of a terminal connector according to the invention.
Figure 2:
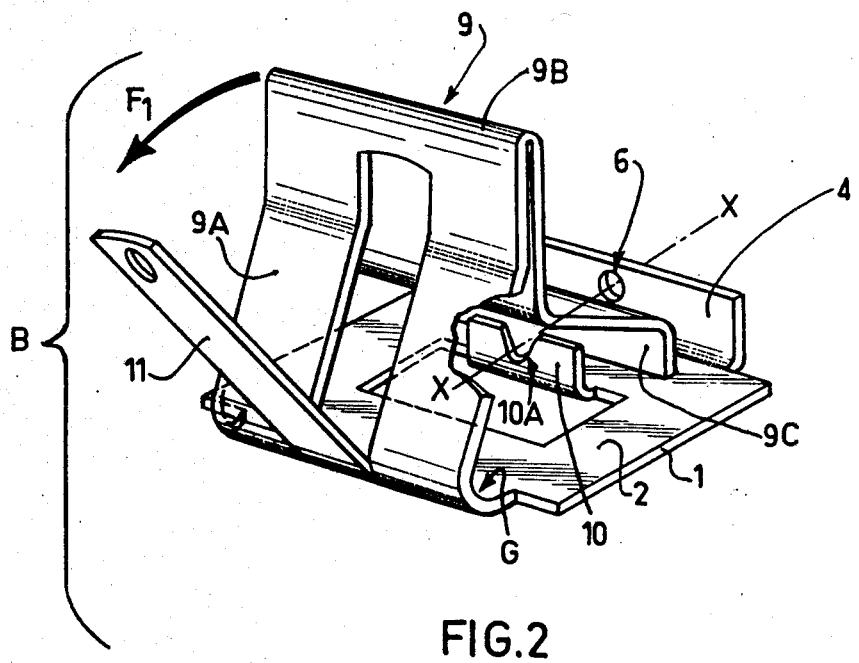
FIG. 2 is a perspective view, with part shown in section, of a metal lug of this terminal.
Figure 3:
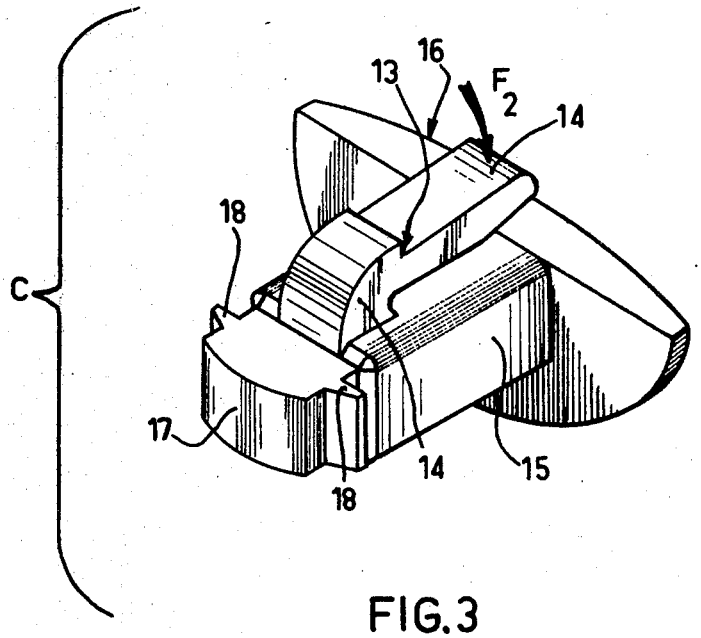
FIG. 3 is a perspective view of the actuating button of this same terminal.

In the embodiment shown, a terminal connector according to the invention comprises a set of three elements: a casing A, a metal lug B and a digital actuating button C (FIGS. 1, 2 and 3).

Lateral wings 1 of an anchoring base 2 of the lug B are slidable in guide grooves 3A formed in a terminal connector box 3 on the base 3B of the casing A until the lug B reaches a stop 3C. When the lug B is fully inserted return 4 of this lug is arranged against an entrance opening 5 of the casing. The return 4 has a hole 6 formed therein which comes into registration with the the opening 5.

The opening 5 is in the end of the natural extension of a cylindroconic inner guide 7 formed in an entry and protection cone 8 of the casing, through which the electric wire E is inserted into the terminal.

Opposite the return 4 the anchoring base 2 of the lug B an arm 9 bent several times so as to have a portion 9A attached to the base 2, a hairpin portion or movable flap 9B in front of the push-button C and a return portion 9C normally in front of the return 4 having the hole 6 therein.

In alignment with an axis X—X, which passes through the center of the hole 6, there is arranged a notch-like channel 10A in a wire support and contact 10. The wire support 10 and integral channel 10A are formed by a cut out in the anchoring base 2 which is folded 90°.

The axis X—X is, when the lug is in its biased position, broken by the return 9C which extends between the return 4 and the support and contact 10.

Lug B is formed of an electrically conductive material and the portion 9A of the arm 9 has a cut out therein angled outwardly relative thereto to constitute an electrical connecting terminal 11.

The push-button C passes through the box of the casing A through an opening 12. The opening is provided at one point along its periphery with a retaining notch 12A which can come into engagement with a locking notch 13 formed on outwardly biased tang 14 arranged laterally to the prismatic principal body 15 of the push-button C.

The prismatic body 15 carries at one end a digital push zone, i.e., a button 16 and, at its other end, a push stop 17 which in turn is provided with laterally extending retaining tangs 18.

The spring tang 14 constitutes through its free end an unlocking lever, which unlocking is obtained by lateral action exerted on said free end of the tang substantially perpendicular to the direction of the digital push action obtained through movement of the button 16.

Figure 4:
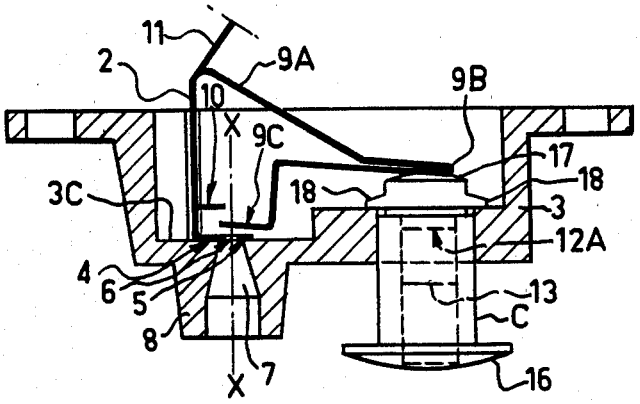
FIG. 4 shows, in partial section and on a smaller scale, a terminal connector according to the invention in which the casing, the lug and the button have been mounted together.

The assembly of the whole is effected as follows: the lug B is inserted into the casing A inside the connecting box 3 by the wings 1 being slid into the guide grooves 3A until the lug stop 3C is engaged. The push-button C is inserted in the casing A through the prismatic opening 12. The flexible retaining tangs 18 flex inwardly as they pass through the opening and than extend outwardly behind the opening to ensure a reliable connection of the button C in the casing A. At this moment, the push stop 17 of the button is juxtaposed against the push portion 9B of the lug B which resting position (FIG. 4).

The principle of use is as follows.

Figure 6:
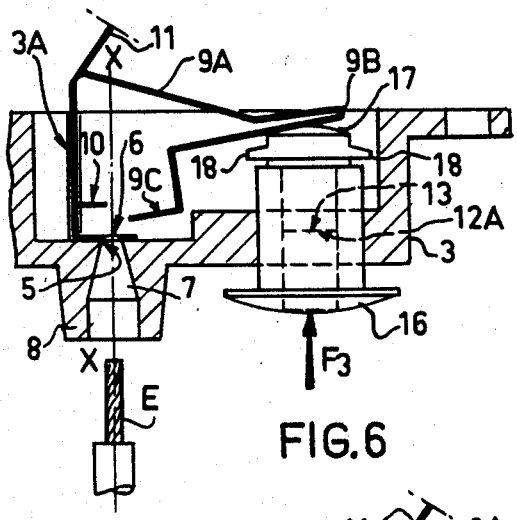
FIG. 6 shows, in partial section, the terminal connector according to the invention when the flap is retracted, corresponding to the position when the device is waiting for a wire to be inserted.
Figure 5:
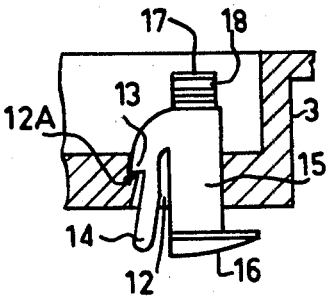
FIG. 5 shows, in partial section, the actuating button in its housing.

To obtain the connection of a wire, pressure is exerted on the digital push zone 16 of the push-button C until the spring tang 14 is engaged due to its locking notch 13 catching in the retaining notch 12A of the casing A (FIGS. 5 and 6). The action of the push stop 17 of the push-button C on the movable portion 9B of the metal lug B causes movement thereof, as indicated along the arrow F1 and thereby moves the movable wire retaining portion 9C about the axis G by deforming the arm 9 of the lug B (FIG. 6). When the device is in the condition as shown in FIG. 6 it permits the free entry of the bared wire E to pass through the guide zone 7, then through the hole 6 of the return 4 and past the wire support and contact 10. It can be seen that when the wire is in this position, the push-button can then be released with the finger by a pressure in the direction of F2 (FIG. 3) on the end of the tang 14. The actuation of the end of the tang 14, i.e., the locking lever, will act to unlock the notches 12A and 13 from one another. The curved portion of the spring-like tang 14 tends to cause the button recover its first position, i.e., its extended position by wedging outwardly and coacting with the hole 12 to force the button outwardly. The bared wire is then secured in its connecting position (FIG. 7) and retained against any slippage by the biased wire retaining portion 9C. The biasing being caused by the spring-like material of which the lug B is formed. It should be noted that the button C is stopped at its initial position by the retaining tangs 18 limiting its travel.

To achieve disconnection of the wire, the same operation is recommenced and the wire is pulled when the push-button C is depressed (FIG. 6).

Figure 7:
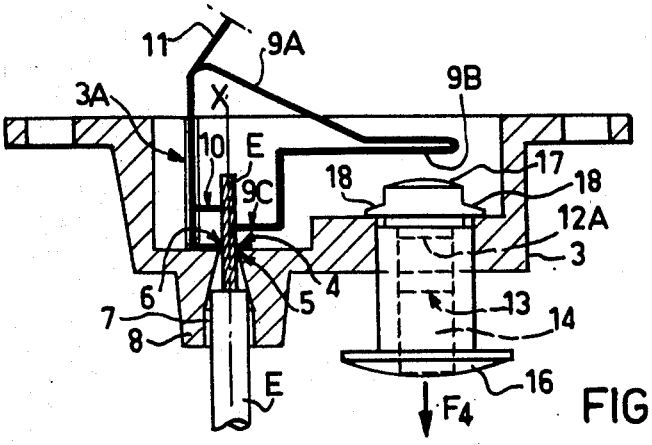
FIG. 7 is a view similar to that of FIG. 6, but in an operating position corresponding to when the connection of a wire is complete.

The unlocking and locking positions are shown in FIGS. 6 and 7 and the direction of movement of the button to obtain these positions is indicated by the arrows F3 and F4. It should be noted that the positions could be obtained, without departing from the scope of the invention, by rotation or by rocking of a push-button or the unlocking could be achieved by a second rectilinear thrust. According to the invention and in other words, a first position of the push-button enables the free passage of the wire which will then find itself fixedly secured by a second action on this same button, and satisfactory reliability is achieved to cover a very wide range of use.

It is well understood that the present invention has only been described and illustrated by way of preferred example and that equivalents could be introduced into its constituent elements without, however, departing from the scope of the invention which is as is defined in the following claims.

I claim:

1. Terminal connector for electrical wires, said connector comprising:

a casing;

a wire entrance formed in said casing;

a wire receiving support arranged in said casing;

an actuating button;

a lateral flexible strip of said actuating button;

a notch formed on said flexible strip;

a movable flap for interposing between said entrance and said receiving support and for lateral wedging of the wire, which flap is operable by said actuating button;

a complementary notch formed on said casing, said notches constituting locking means to hold said button and said flap in a retracted position permitting introduction of the wire.

2. Terminal connector according to claim 1, comprising a connecting lug, said interposing and lateral wedging flap forming part of said lug.

3. Terminal connector according to claim 1, comprising a connecting lug, said interposing and lateral wedging flap and said receiving support forming part of said lug.

4. Terminal connector according to claim 1, comprising a holding means provided on said button, said holding means resisting the total withdrawal of said button from said casing.

5. Terminal connector according to claim 1, comprising:

an entrance and wire protecting cone formed on said casing;

an inner guidance of the wire being effected in said entrance cone.

6. A wiring device, adapted to releasably connect the end of a wire thereto, including a casing having a wire entrance therein, a lug means of an electrically conductive material having a wire receiving and contacting support means and a movable means adapted to cooperate with said support means, said lug means being adapted to be positionable in a first or a second position wherein one of said first and second positions blocks said wire entrance, and actuating means cooperating with said casing for shifting said movable means on said lug means between said first and second positions, said means for shifting having means for releasably locking said lug means in one of said first and second positions, whereby pressure applied to said actuating means will move said movable means to and lock it in one of said first and second positions unblocking said entrance to thereby permit the insertion of the end of a wire, release of said means for locking then permitting said movable means on said lug to shift in a biased manner to engage and hold said wire against said support means.

7. A wiring device as set forth in claim 6, wherein said actuating means includes a notch therein engageable by a complementary notch formed in said casing, said notches forming said releasable locking means.

8. A wiring device as set forth in claim 6, wherein said actuating means includes a laterally flexible strip having a notch formed therein, and complementary notch means formed on said casing cooperating with said notch on said strip forming said locking means.

9. A wiring device as claimed in claim 6, wherein said lug means, said movable means and said support means are integrally formed as a single piece.

10. A wiring device as claimed in claim 6, wherein said lug means includes means thereon for attachment of a second wire whereby a positive electrical connection is made between said wires.

11. A wiring device as claimed in claim 6, wherein said actuating means including a button on one end and laterally projecting flexible tangs at the other end.

* * * * *